US007123217B2

(12) United States Patent
Kawanami et al.

(10) Patent No.: US 7,123,217 B2
(45) Date of Patent: Oct. 17, 2006

(54) METHOD FOR DRIVING PLASMA DISPLAY PANEL

(75) Inventors: Yoshimi Kawanami, Kawasaki (JP); Yasuhiko Kunii, Kawasaki (JP); Hitoshi Hirakawa, Kawasaki (JP); Takashi Shiizaki, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 374 days.

(21) Appl. No.: 10/361,633

(22) Filed: Feb. 11, 2003

(65) Prior Publication Data

US 2003/0218581 A1 Nov. 27, 2003

(30) Foreign Application Priority Data

May 27, 2002 (JP) ..... 2002-151857

(51) Int. Cl.
*G09G 3/28* (2006.01)

(52) U.S. Cl. ..... 345/60; 345/63; 345/68; 345/72; 345/209; 345/204; 315/169.1; 315/169.4

(58) Field of Classification Search ..... 345/60–72, 345/204, 209; 315/169.1–169.4
See application file for complete search history.

(56) References Cited

U.S. PATENT DOCUMENTS 5,541,618 A * 7/1996 Shinoda ..... 345/60
6,236,380 B1 * 5/2001 Wani et al. ..... 345/60
6,388,643 B1 5/2002 Huang
6,778,152 B1 8/2004 Huang
6,809,707 B1 * 10/2004 Holtslag ..... 345/60
2002/0063663 A1 * 5/2002 Homma

FOREIGN PATENT DOCUMENTS

TW 00389883 5/2000
TW 00426840 3/2001

OTHER PUBLICATIONS

Official Communication received from the Taiwanese Patent Office dated Oct. 22, 2004.

* cited by examiner

*Primary Examiner*—Richard Hjerpe
*Assistant Examiner*—Jennifer T. Nguyen
(74) *Attorney, Agent, or Firm*—Staas & Halsey LLP

(57) ABSTRACT

A driving method of a plasma display panel is provided in which effective resolution and luminance in a display of fields that constitute a frame are improved. The method includes dividing each of M (M≧2) fields that constitute a frame into K (K≧2) subfields having luminance weight, displaying the k (1≦k<K) subfields selected in descending order of the luminance weight in progressive format using all display lines out of the K subfields and displaying the remaining subfields in interlaced format using the display lines selected at regular intervals at a ratio of one per M display lines in arrangement order.

4 Claims, 7 Drawing Sheets

METHOD FOR DRIVING PLASMA DISPLAY PANEL

BACKGROUND OF THE INVENTION

1. Field of the Invention

The present invention relates to a method for driving a plasma display panel (PDP).

The development is so advanced that a PDP has a high-definition large screen. A driving method is desired in which a brighter display can be achieved using a screen having many display lines.

2. Description of the Prior Art

There are two types of display forms of a frame as image data; one is an interlaced display and another is a progressive display. In the interlaced display, a frame is divided into plural fields so that the fields are displayed sequentially. Generally, the number of fields is two. In this case, odd display lines are used to display one of the fields, and even display lines are used to display the other field. More specifically, every other display line is used to display one field. As the number of fields is larger, the number of display lines used for one field is smaller. In the progressive display, all N display lines forming a display surface are used, and display contents are set for each of the display lines individually.

In a display using an AC type PDP, an addressing process is performed in a line-sequential manner for setting wall voltage of sells in accordance with display data, and then a sustaining process is performed for applying sustain voltage pulse to the cells. In other words, ON or OFF of light emission is determined in the addressing process and display discharge is generated in the sustaining process, the number of times of the display discharge corresponding to the display data. Since a cell of a PDP is basically a binary light emission element, it is impossible to display an image having pixels whose brightness is different from each other in a single addressing process. Therefore, in the interlaced display, one field is divided into plural subfields, and then the addressing process and the sustaining process are performed for each subfield. It is supposed that a subfield division number K is 8, and a ratio of luminance weight, i.e., a ratio of light emission amount with respect to total of eight times of sustaining processes is 1:2:4:8:16:32:64. The selection of subfield allows displaying 256 gradation levels from 0 to 255. In a display of an image having a frame rate of 30 such as a television image in NTSC format or general computer output, the addressing process and the sustaining process are conducted K times during the driving period for one field (1/60 seconds). Similar method is used to perform gradation reproduction also in the progressive display. A color display is one kind of a gradation display, and a display color is determined by combination of gradation of red, green and blue colors.

A digital signal processing technique enables not only an interlaced display of a frame in which the original image is interlaced like a television, but also a progressive display. A frame is only written into a memory to read out necessary portions. It is also possible to display a non-interlaced (progressive) frame such as computer output in interlaced format. It is an option in designing of a drive circuit whether a PDP adopts the progressive display or the-interlaced display. The progressive display has an advantage over the interlaced display in respect of effective resolution (sharpness perceived by naked eye), however the interlaced display is sometimes adopted. For example, in a high-definition PDP in which display electrodes are arranged at regular intervals at a ratio of three per two display lines, the interlaced display is adopted by reason that drive sequence is simple compared to the case of the progressive display. Further, if a frame input to the drive circuit is the interlaced format, signals are processed easily in the interlaced display compared to the progressive display.

There are the following three problems in the interlaced display. First, effective resolution is low. In the case of the high-definition PDP mentioned above, the effective resolution is approximately 70% of the progressive display. Secondly, a picture is required to be brightened by increasing drive frequency in the sustaining process. The drive frequency is increased, thereby leading to the increased power loss due to charge of capacitance in cells. Lastly, flickers are conspicuous in a display of a still picture. In order to solve these problems, a frame is divided into plural subframes so that the subframes are displayed in progressive format, the number of subframes being equal to the number of subfields in the interlaced display. Then, the time required to perform the addressing process is doubled, and the time capable of being allocated to the sustaining process is reduced by just that much. Especially, in a PDP designed for an XGA (eXtended Graphics Array) and resolution higher than the XGA, all display lines are used; thereby, average luminance of the entire display surface per one pulse in the sustaining process is higher than the case of the interlaced display. However, small amount of pulse can be applied during the sustain period and the number of times of discharge is small, therefore the average luminance of the entire display surface is practically reduced.

SUMMARY OF THE INVENTION

It is an object of the present invention to enhance effective resolution and luminance in a display of fields that constitute a frame. It is another object of the present invention to increase luminance of a display using a PDP designed for high resolution.

According to one aspect of the present invention, a field includes a plurality of subfields having luminance weight, and one or more subfields selected in descending order of the luminance weight are displayed in progressive format using all display lines and the other subfields are displayed in interlaced format using display lines that remain after subtraction of some display lines at a constant rate in arrangement order. In the progressive format, the number of lighted display lines in the subfield is two times more than that of the interlaced display by simple arithmetic. Additionally, display contents for all of the display lines are set individually in accordance with display data; therefore effective resolution is exactly equal to the number of display lines. Since the progressive format is applied to the subfields having larger luminance weight, improvement effect of the luminance and the effective resolution in the entire field is large, compared to the case where the progressive format is applied to the subfields having smaller luminance weight. However, it is not always true that as the number of subfields using the progressive format is larger, the luminance is higher. This is because the progressive format requires longer time for an addressing process than the interlaced format does; therefore, as the number of subfields using the progressive format is larger, the time capable of being allocated to the sustaining process is shorter. The time required for the addressing process depends on the number of display lines. Accordingly, in the case of application of the present invention, it is preferable that the number of subfields displayed in the progressive format is determined in a manner to maximize the improvement effect in accordance with the number of display lines in a plasma display panel to be applied.

DESCRIPTION OF THE PREFERRED EMBODIMENTS

Hereinafter, the present invention will be explained more in detail with reference to embodiments and drawings.

[First Embodiment]

Figure 1:
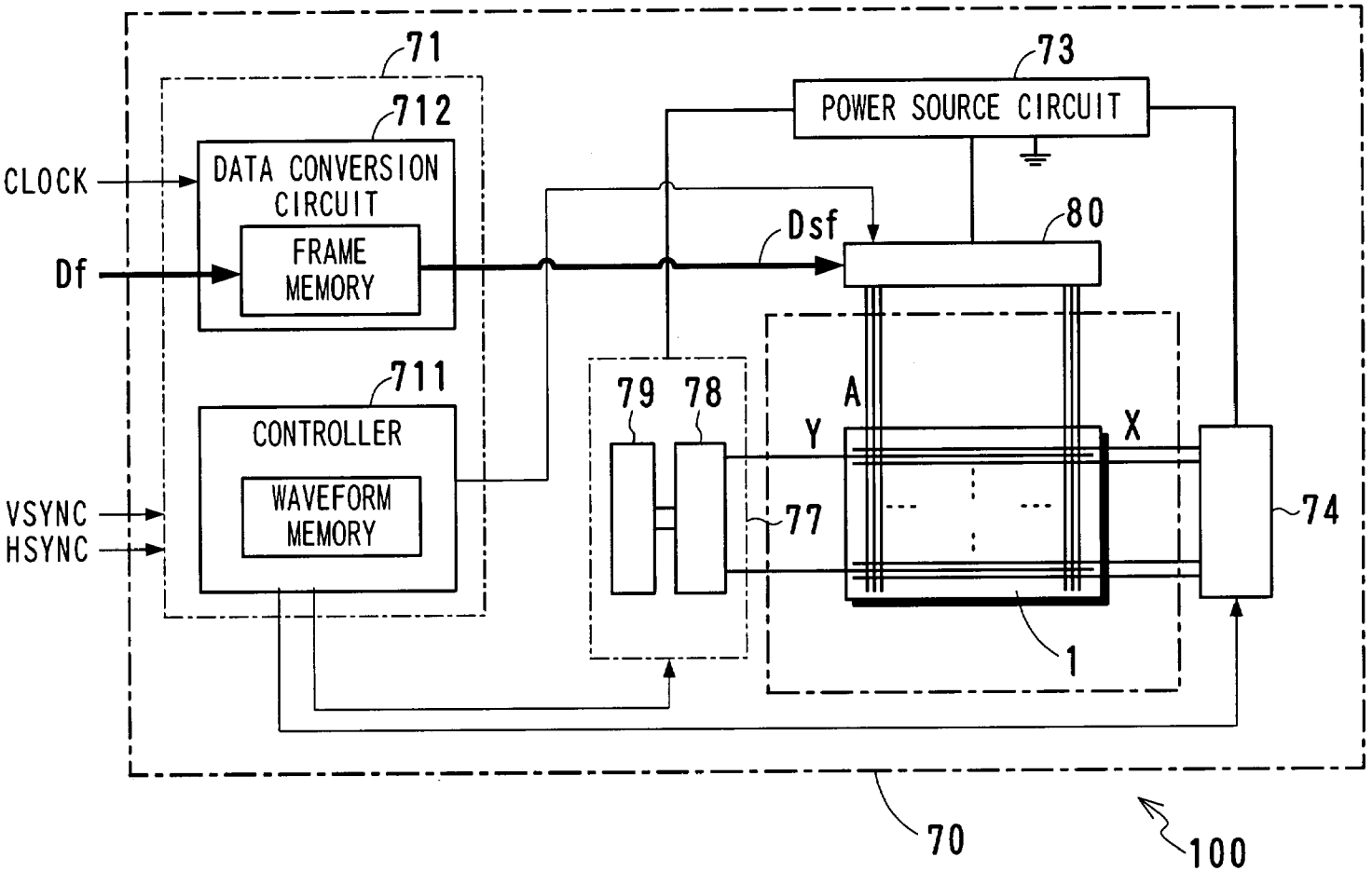
FIG. 1 is a diagram showing a structure of a plasma display device according to a first embodiment.

FIG. 1 is a diagram showing a structure of a plasma display device according to a first embodiment. The display device 100 includes a three-electrode surface discharge AC type PDP 1 having a display surface including m×n cells and a drive unit 70 for selectively lighting cells. The display device 100 is used as a wall-hung type television set or a monitor for a computer system.

The drive unit 70 includes a control circuit 71 for controlling drive, a power source circuit 73, an X-driver 74, a Y-driver 77 and an address driver 80. The control circuit 71 has a controller 711 and a data conversion circuit 712. The controller 711 is provided with a waveform memory for memorizing control data of drive voltage. The X-driver 74 is so structured that each of the display electrodes X is biased to potential different from that of the two adjacent display electrodes X. Thereby, upper cells and lower cells in each of the display electrodes Y can be selected individually in an addressing process. The Y-driver 77 includes a scan circuit 78 and a common driver 79. The scan circuit 78 is potential switching means for selecting a display line in the addressing process and controls potential of the display electrodes Y individually. The common driver 79 switches the potential of the display electrodes Y collectively. The address driver 80 switches potential of total of m address electrodes A based on subframe data Dsf. The power source circuit 73 supplies these drivers with electricity properly.

The drive unit 70 is supplied with frame data Df as multi-valued image data indicating luminance levels of red, green and blue colors together with synchronizing signals CLOCK, VSYNC and HSYNC from an external device such as a TV tuner or a computer. The frame data Df are temporarily stored in a frame memory of the data conversion circuit 712, and then converted into subfield data Dsf for a gradation display to be transferred to the address driver 80. A value of each bit of the subfield data Dsf indicates whether the cell is required to be lighted or not in the corresponding subfield, more specifically whether address discharge is required or not.

Figure 2:
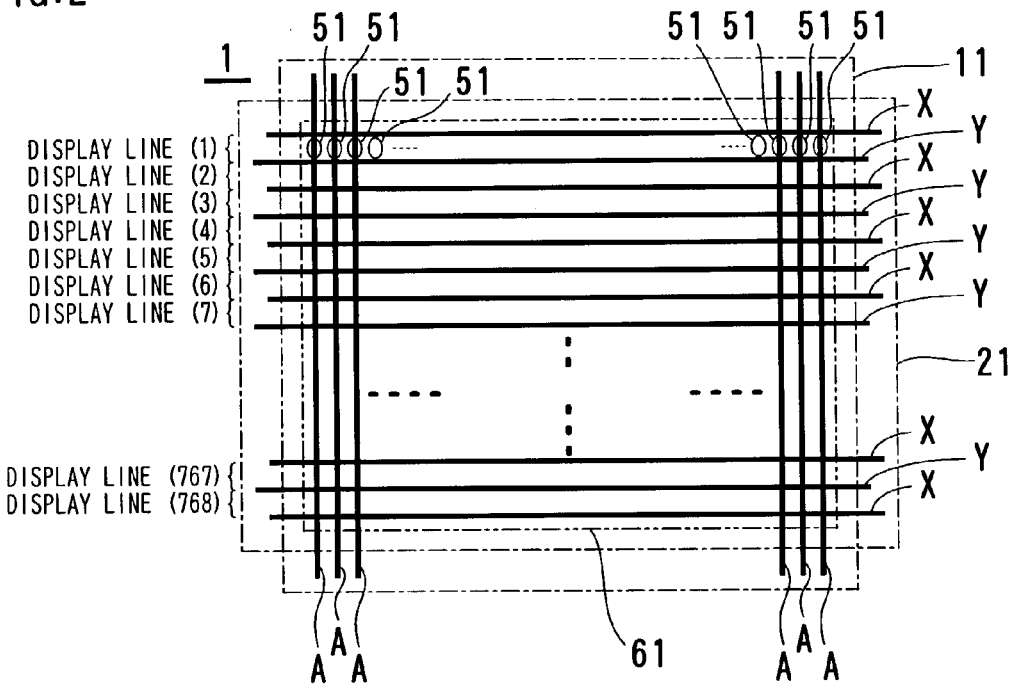
FIG. 2 is a schematic diagram of an electrode matrix of a PDP according to the first embodiment.

FIG. 2 is a schematic diagram of an electrode matrix of the PDP according to the first embodiment. The PDP 1 to be driven is a high-definition PDP in which each of the display electrodes X and each of the display electrodes Y are arranged alternately at regular intervals at a ratio of three per two display lines as shown in FIG. 2. Each of two adjacent display electrodes Y and the neighboring display electrode X make respective electrode pairs for generating surface discharge, and each electrode pair is used to control one display line. The display line is a cell array along the display electrode Y, in other words, a group of cells to be lighted when a horizontal line is displayed, the horizontal line having a width of one cell and extending over the entire length of the display surface 61. In the drawing, with respect to only the first display line (1), cells 51 are shown by ellipses, as a type. The specification of the display surface 61 is an XGA whose number of display lines N is 768 and the total number of display electrodes X and display electrodes Y is 769 (=N+1). Since the display electrodes X and the display electrodes Y are parallel to each other, the address electrodes A are arranged on the display surface 61 at regular intervals in the horizontal direction in order to select each of the cells 51.

Figure 3:
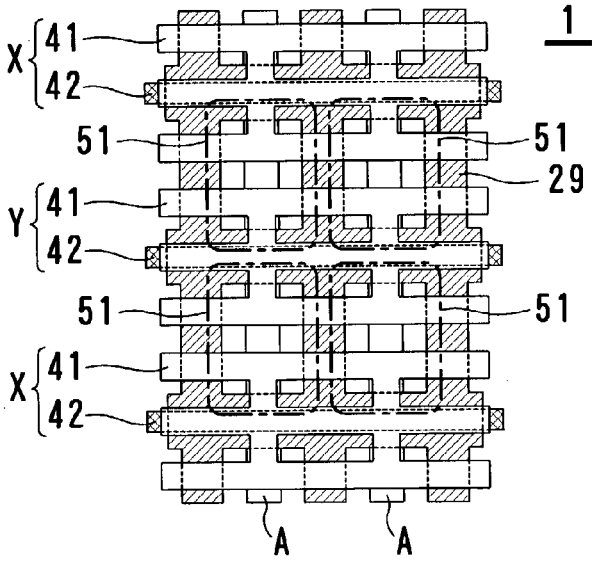
FIG. 3 is a plan view showing electrode arrangement in cells of the PDP according to the first embodiment.

FIG. 3 is a plan view showing electrode arrangement in the cells of the PDP according to the first embodiment. Each of the display electrodes X and each of the display electrodes Y includes a transparent conductive film 41 and a metal film 42. The transparent conductive film 41 is patterned in such a manner as to have a gap for reducing the electrode area so that discharge current is reduced to enhance light emission efficiency. The transparent conductive film 41 protrudes into both sides of a portion in the horizontal direction of a mesh-pattern partition 29 enclosing the cells 51, the portion being referred to as a horizontal wall below; thereby the transparent conductive film 41 forms a surface discharge gap for each cell together with the neighboring transparent conductive film 41. The metal film 42 is a bus conductor for enhancing conductivity and positioned so as to be overlapped with the horizontal wall.

Figure 4:
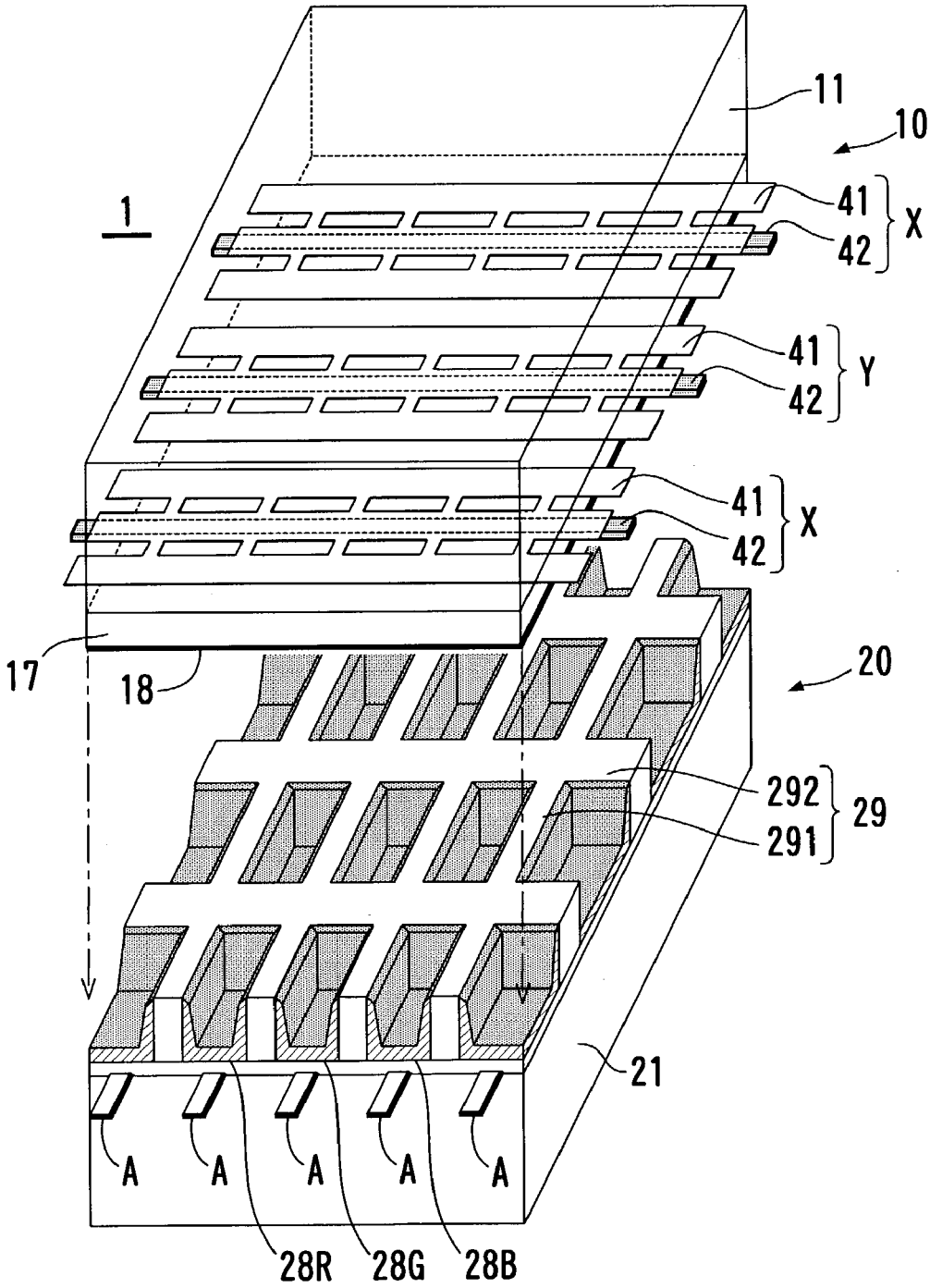
FIG. 4 is a diagram showing a cell structure of the PDP according to the first embodiment.

FIG. 4 shows a cell structure of the PDP according to the first embodiment. The PDP 1 includes a pair of substrate structural bodies (each of which has a substrate and cell elements thereon) 10 and 20. The display electrodes X and Y are arranged on an interior surface of a glass substrate 11 as a base material of the front substrate structural body 10 at the same pitch as the display line pitch. The display electrodes X and Y are covered with a dielectric layer 17 whose surface is coated with magnesia (Mgo) as a protection film 18. The address electrodes A are arranged on an interior surface of a glass substrate 21 as a base material of the rear substrate structural body 20 in such a manner that one address electrode A corresponds to one column. The address electrodes A are covered with a dielectric layer 24. The partition 29 having a height of approximately 150 μm is formed on the dielectric layer 24. The partition 29 includes a portion 291 for defining a discharge space for each column (hereinafter referred to as a vertical wall) and a portion 292 for defining the discharge space for each display line (the horizontal wall mentioned above). The surface of the dielectric layer 24 and the side surfaces of the partition 29 are covered with a fluorescent material layer 28R, 28G or 28B having red, green and blue colors respectively for a color display. The color arrangement has a repetition pattern of red, green and blue colors in which cells of each column have the same color. Each of the fluorescent material layers 28R, 28G and 28B is excited by ultra violet rays emitted from a discharge gas during the surface discharge so as to emit light. Since the partition pattern is a mesh pattern, discharge interference does not occur in the column direction, differently from the case of a stripe pattern in which the horizontal wall 292 is omitted. More specifically, the PDP 1 can realize the progressive display without complicated drive sequence. Further, the side surfaces of the horizontal wall 292 are provided with a fluorescent material, thereby resulting in improved light emission efficiency.

Figure 5A:
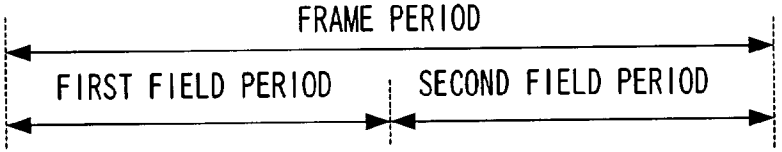
FIGS. 5A and 5B are diagrams showing period setting in drive sequence.
Figure 5B:
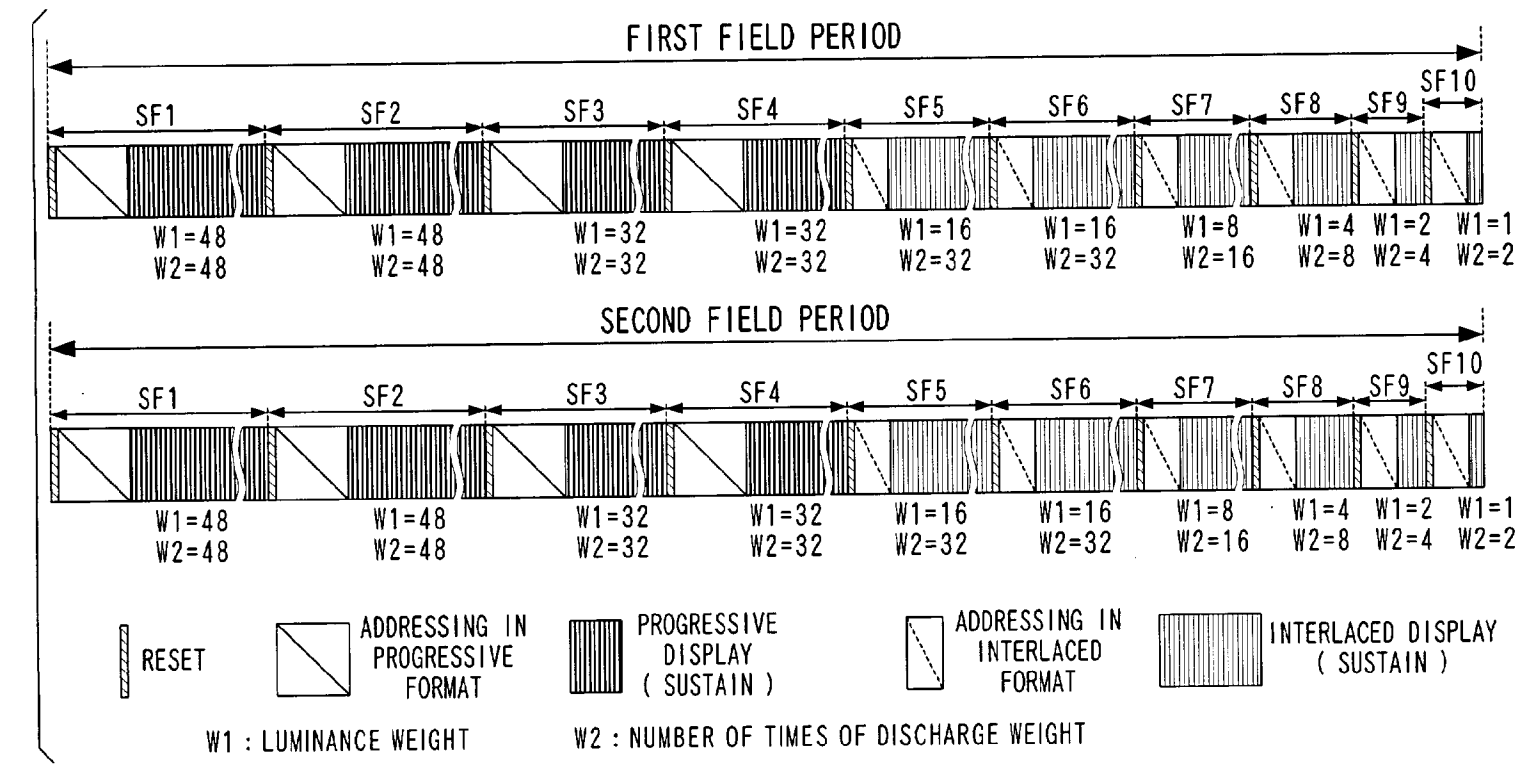

The driving method of the PDP 1 will be described below. FIGS. 5A and 5B are diagrams showing period setting in drive sequence. A frame to be displayed in the present example is 2:1 interlaced format. As shown in FIG. 5A, a frame period allotted to one frame is divided into a first field period and a second field period. For a gradation display, each of the fields is divided into ten subfields SF1, SF2, SF3, SF4, SF5, SF6, SF7, SF8, SF9 and SF 10 having respective luminance weights, to each of which periods are allocated as shown in FIG. 5B, the periods being division of the field period. The luminance weight W1 of the subfields SF1 to SF 10 is 48, 48, 32, 32, 16, 16, 8, 4, 2 and 1 respectively, and 208 gradation levels can be displayed. Weight W2 that is shown with the luminance weight W1 in FIG. 5B is weight of the number of times of the display discharge (referred to as the number of times of discharge weight). The relationship between the luminance weight W1 and the number of times of discharge weight W2 will be described later. The subfields SF1 to SF10 are placed in descending order of the luminance weight W1 in FIG. 5B, however, display order (weight arrangement) is not limited to the order. For example, as a method for reducing dynamic pseudo contour, it is known that the weight arrangement is selected in a manner to prevent the center of light emission time from changing greatly for each gradation level.

Each of the periods allocated to each of the subfields SF1 to SF10 has a reset period, an address period and a sustain period (also called a display period). The reset period is a period for initializing wall charge, in which charge states of all cells within the display surface are equalized. The length of the reset period is equal in each of the subfields SF1 to SF10. The address period is a period for an addressing process, in which wall charge necessary for display discharge is generated only in cells to be lighted during the sustaining process. As the addressing operation, a scanning process is performed for applying scan pulse to the display electrodes Y corresponding to the display lines used for a display sequentially, and in synchronism with the scanning process, all of the address electrodes A are controlled to potential in accordance with display data at every display line. Address discharge for varying the wall charge is generated only in a cell that the scan pulse is applied to and the address electrode A is biased to the predetermined address potential. The length of the address period is in proportion to the number of display lines used for a display. The sustain period is a period for generating display discharge whose number of times corresponds to the luminance weight W1 of the subfield. Sustain pulse having amplitude lower than discharge-starting voltage is applied to all of the cells. More specifically, the display electrode Y and the display electrode X are biased to sustain potential alternately; thereby alternating voltage is applied between the display electrodes. The display discharge is generated only in cells where the predetermined wall voltage is superimposed upon the voltage of the sustain pulse (the cells to be lighted mentioned above). The discharge makes polarity of the wall charge reverse, and the next application of the sustain pulse causes display discharge again. Such an operation is repeated so that amount of light corresponding to the luminance weight W1 (integral light emission amount) is emitted from the fluorescent material. The length of the sustain period is in proportion to the number of times of discharge weight W2.

It is important in the field structure shown in FIGS. 5A and 5B that the four subfields SF1 to SF4 selected in descending order of the luminance weight W1 are displayed in progressive format, and the remaining six subfields SF5 to SF10 are displayed in interlaced format, the progressive format using all of the display lines and the interlaced format using every other display line. Odd display lines are used in the subfields SF5 to SF10 of the first field and even display lines are used in the subfields SF5 to SF10 of the second field. Compare to the subfields SF5 to SF10 in the interlaced format, the subfields SF1 to SF4 in the progressive format require twice the time for the addressing process. However, the average luminance of the entire display surface in the subfields SF1 to SF4 is twice that of the subfields SF5 to SF10 and effective resolution in the former is larger (equal to the number of display lines) than that of the latter. Accordingly, the description above means that the application of the progressive format improves the luminance and increases the effective resolution in the entire of the field.

As described above, as the number of times of discharge weight W2 is larger, the sustain period is longer. This is ingenuity for accurate gradation reproduction in a field where the progressive display and the interlaced display are mixed. When the sustain period is in proportion to the luminance weight W1 similarly to the conventional method using only the interlaced display, gradation continuity can not be obtained. This is because the average luminance of the progressive display is twice that of the interlaced display even if the luminance weight W1 is the same in both the displays. Therefore, it is possible to consistent with the progressive display by doubling the sustain period of the subfields SF5 to SF10 in the interlaced display, and doubling the number of times of the display discharge for enhancing the average luminance.

Figure 6:
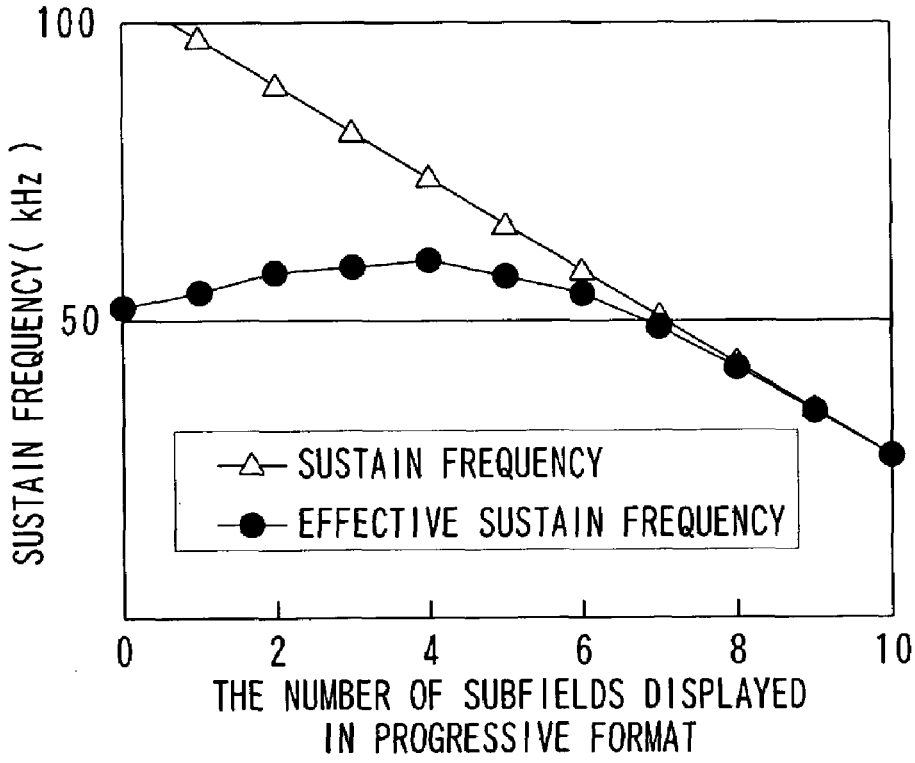
FIG. 6 is a graph for explaining optimization of a field structure according to the first embodiment.

FIG. 6 is a graph for explaining optimization of the field structure according to the first embodiment. This graph shows the relationship between the luminance in the entire field and the number of subfields displayed in the progressive format out of the ten subfields. The luminance when all of the cells are discharged once is used as the reference for calculating the luminance that is converted into sustain frequency to be shown as the vertical axis. A triangle plot shows luminance when the most cells possible in all of the display lines are discharged, that is, the time capable of being allocated to the sustaining process. The addressing process in the progressive display is long. Therefore, as the number of subfields in the progressive display is smaller, the time capable of being allocated to the sustaining process is longer. A dot plot shows luminance when all of the display lines are lighted in the subfields in the progressive display and only every other display line is lighted in the subfields in the interlaced display, the luminance being called effective sustain frequency that is an index of actual luminance in the drive control applying the present invention.

As shown in FIG. 6, under the condition where the number of subfields is constant (the number of gradation levels is constant), some of the subfields having relatively large luminance weight W1 are displayed in the progressive format and the remaining subfields are displayed in the interlaced format; thereby it is found that maximum luminance can be obtained. The maximum luminance is higher than luminance produced by complete interlaced display, i.e., the case where the number of subfields in the progressive display is zero. FIGS. 5A and 5B show that the progressive display in the four subfields SF1 to SF4 produces the highest luminance in the case of the PDP designed for the XGA. According to the weighting shown in FIGS. 5A and 5B, the effective resolution is 716 when the four subfields SF1 to SF4 are displayed in the progressive format. The effective resolution here is defined as a calculated value of average of luminance weight in each of the subfields, supposing that the subfields of the progressive display has resolution equal to the number of display lines and the subfields of the interlaced display has resolution 0.7 times the number of display lines. If the four subfields SF1 to SF4 are displayed in the progressive format, sustain frequency is 30% lower than the case of the complete interlaced display. Therefore, it is possible to prevent losses in a sustain discharge circuit; thereby leading to improved operation efficiency of a drive module.

[Second Embodiment]

Figure 7:
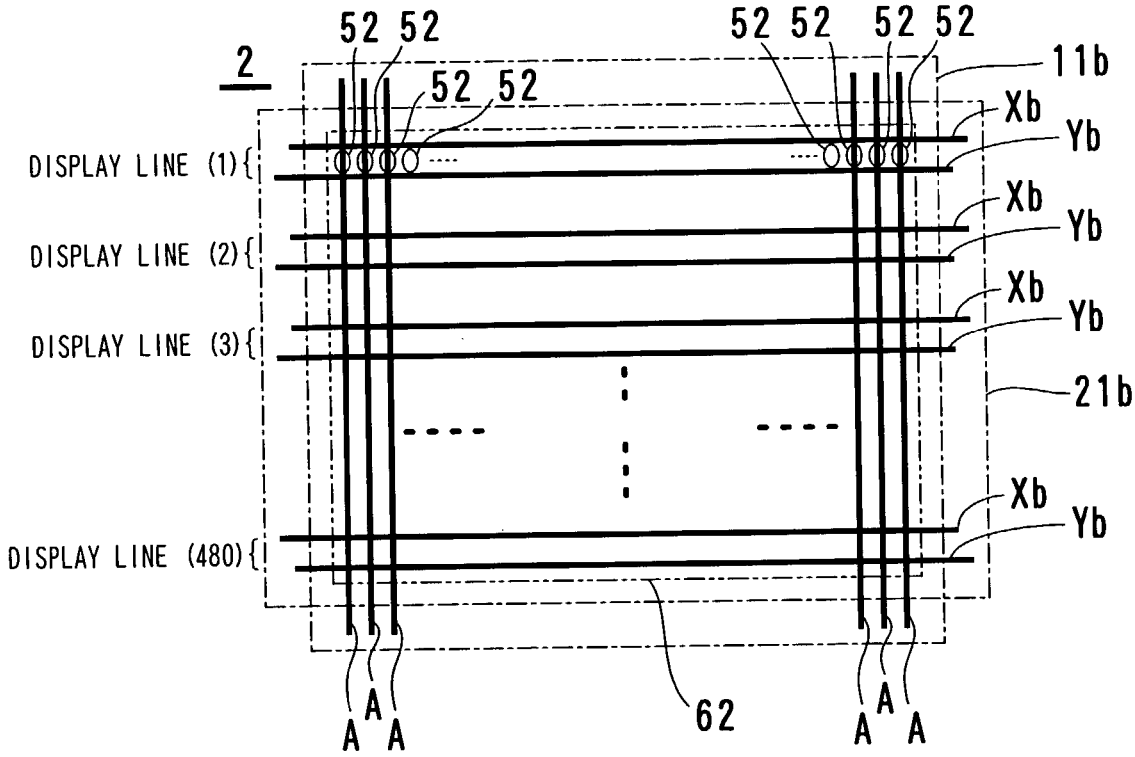
FIG. 7 is a schematic diagram of an electrode matrix of a PDP according to a second embodiment.

FIG. 7 is a schematic diagram of an electrode matrix of a PDP according to a second embodiment. The PDP 2 to be driven is a commonly used type of PDP in which each display electrode Xb and each display electrode Yb are arranged at a ratio of two per one display line as shown in FIG. 7. Each of the display electrodes Xb and the display electrode Yb positioned adjacent thereto make an electrode pair for generating surface discharge, which is used to control one display line. A gap between an electrode in a display line and the adjacent electrode in the neighboring display line is set to be substantially larger than a surface discharge gap; thereby discharge interference between the display lines is prevented. In this case also, the display line is a cell array along the display electrode Yb, in other words, a group of cells to be lighted when a horizontal line is displayed, the horizontal line having a width of one cell and extending over the entire length of the display surface 62. In the drawing, with respect to only the first display line (1), cells 52 are shown by ellipse as a type. The specification of the display surface 62 is a VGA whose number of display lines N is 480 and the total number of display electrodes Xb and display electrodes Yb is 960 (=2N). Since the display electrode Xb and the display electrode Yb are parallel to each other also in the PDP 2, the address electrodes A are arranged on the display surface 62 at regular intervals in the horizontal direction in order to select each of the cells 52.

Figure 8:
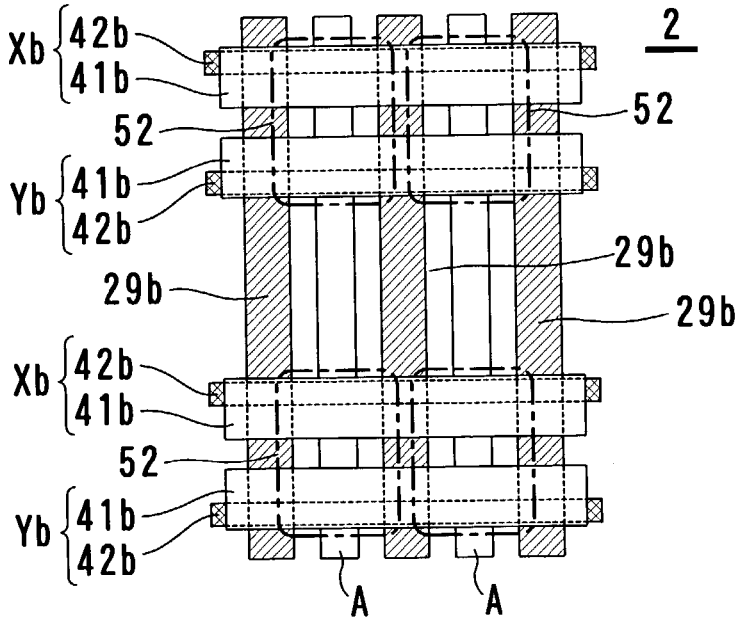
FIG. 8 is a plan view showing electrode arrangement in cells of the PDP according to the second embodiment.

FIG. 8 is a plan view showing electrode arrangement in the cells of the PDP according to the second embodiment. Each of the display electrodes Xb and each of the display electrodes Yb include a transparent conductive film 41*b* and a metal film 42*b*. The transparent conductive film 41*b* is linear band-like and forms a surface discharge gap with the neighboring transparent conductive film 41*b* for each column space defined by a stripe-pattern partition 29*b*. The metal film 42*b* is positioned so as to be overlapped with a portion along one edge of the transparent conductive film 41*b*, the edge being farther away from the surface discharge gap than the other edge.

Figure 9:
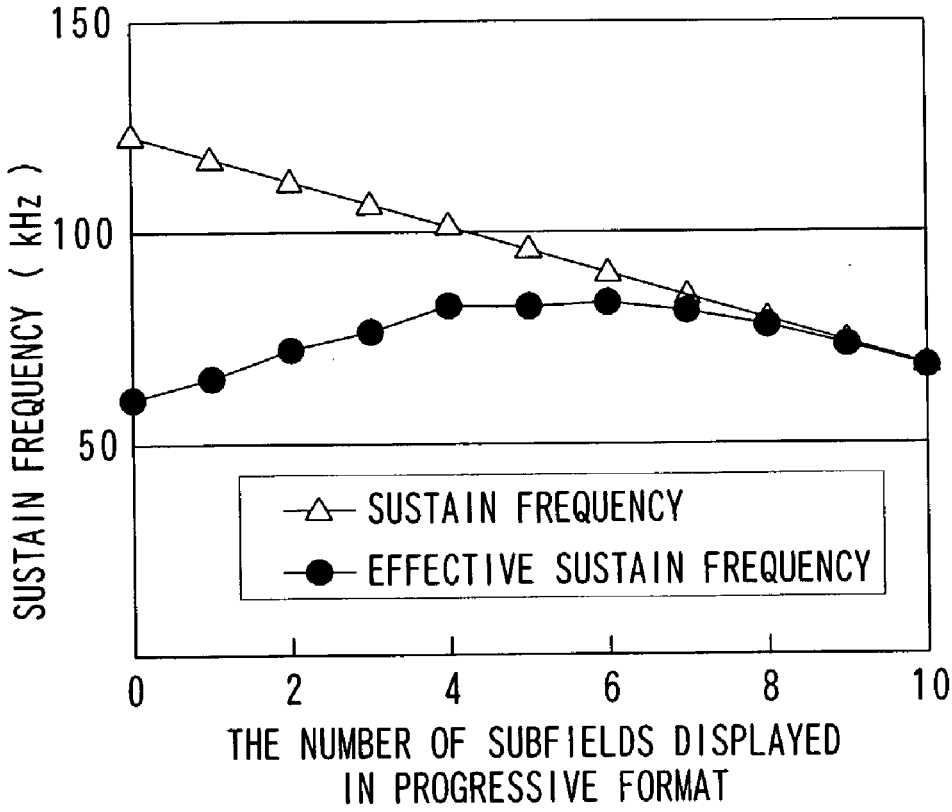
FIG. 9 is a graph for explaining optimization of a field structure according to the second embodiment.

FIG. 9 is a graph for explaining optimization of a field structure according to the second embodiment. Similarly to FIG. 6, this graph also shows the relationship between the luminance in the entire field and the number of subfields displayed in the progressive format out of the ten subfields. In the case of the PDP designed for the VGA also, some of the subfields having relatively large luminance weight W1 are displayed in the progressive format and the remaining subfields are displayed in the interlaced format; thereby maximum luminance can be obtained. The maximum luminance is higher than luminance produced by complete interlaced display, i.e., the case where the number of subfields in the progressive display is zero. FIG. 9 shows that the progressive display in the six subfields SF1 to SF6, each of which has large weight in weighting similar to the case shown in FIGS. 5A and 5B, produces the highest luminance. The effective resolution is 470 when the six subfields SF1 to SF6 are displayed in the progressive format. The description mentioned above is for the case when all cells included in display lines used for a display are lighted. However, display contents depend on display data in an actual display; therefore, it is not necessarily that all of the cells are lighted uniformly.

More specifically, display load varies. The display load is defined as an average value of a ratio Di/Dmax for all cells when a gradation value in an arbitrary cell i in one field is set to Di ($0 \leqq Di \leqq Dmax$). In the case of a known APC (Auto Power Control), which reduces sustain frequency (the number of times of pulse application in this case) so as to limit power consumption below a constant value when the display load is large, the number of subfields in the progressive display is increased to more than six when the sustain frequency is below a preset value. Thus, the effective resolution can be further enhanced. In the present embodiment, complete progressive display can be achieved when the display load is 50% or more.

According to the embodiments described above, it is possible to improve effective resolution and luminance in a display of fields that constitute a frame.

According to the embodiments described above, it is possible to increase luminance of a display using a PDP designed for high resolution. Further, a display with high resolution and high luminance can be achieved.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method for driving a plasma display panel having a luminance corresponding to a number of times of display discharge during a display period, the method comprising:

dividing each of two fields that constitute a frame into K ($K \geqq 2$) subfields having a luminance weight depending on a gradation to be displayed;

displaying the k ($1 \leqq k < K$) subfields having a large luminance weight in a progressive format using all display lines out of the K subfields; and displaying the remaining subfields in an interlaced format using odd-numbered display lines and even-numbered display lines alternately in each of the fields, wherein a ratio of number of times of display discharge to the luminance weight in the subfield displayed in the interlaced format is set to twice a ratio of a number of times of the display discharge to the luminance weight in the subfield displayed in the progressive format.

2. The method according to claim 1, wherein the number k of subfields displayed in the progressive format is larger in a field in which a display load exceeds a preset value than in a field in which a display load is below the preset value.

3. A method for driving a surface discharge type plasma display panel, comprising:

first display electrodes and second display electrodes that extend over a front substrate along a horizontal direction, the first display electrodes and the second display electrodes being spaced out alternately;

address electrodes that extend over a rear substrate along a vertical direction so as to cross the first and second display electrodes;

discharge cells defined at respective intersections of the address electrodes and respective interspaces between the first display electrodes and the second display electrodes;

a mesh-patterned partition dividing a screen and defining the discharge cells; and N display lines that are defined between (N+1) of the first display electrodes and the second display electrodes, each of the display lines being made up of a group of respective discharge cells along the display electrodes, the method comprising:

constituting one frame of two fields;

dividing each of the two fields that constitute one frame into K ($K \geqq 2$) subfields having respective luminance weights;

displaying, in each of the two fields, k ($1 \leqq k < K$) subfields selected in a descending order of the luminance weights in a progressive format, using all of the display lines that are located on both sides of each second display electrode, used as a scan electrode, out of the K subfields; and displaying, alternately in the two fields, the remaining subfields in an interlaced format using the odd-numbered or even-numbered display lines that is located on an upper side or a lower side of the second display electrode;

wherein a ratio of a number of times of display discharge to a luminance weight in the subfield displayed in the interlaced format is set to twice a ratio of a number of times of the display discharge to a luminance weight in the subfield displayed in the progressive format.

4. A plasma display device having a surface discharge type plasma display panel to be driven to display an image, the plasma display panel comprising:

a display surface,

N display lines constituting the display surface, and a total of (N+1) display electrodes arranged on the display surface at regular intervals at a ratio of three per two display lines, wherein each of two fields that constitute a frame is divided into K ($K \geqq 2$) subfields having respective luminance weights, k ($1 \leqq k < K$) subfields selected in a descending order of the luminance weights are displayed in a progressive format, using all of the display lines out of the K subfields, and the remaining subfields are displayed in an interlaced format using the display lines selected at regular intervals at a ratio of one per two display lines in an arrangement order, and said plasma display device further including a control circuit controlling a number of times of display discharge during a display period in each of the subfields so that a ratio of the number of times of display discharge to a luminance weight in the subfield displayed in the interlaced format is set to twice a ratio of a number of times of the display discharge to a luminance weight in a subfield displayed in the progressive format.

* * * * *